US007732391B1

(12) United States Patent
Rosenbaum et al.

(10) Patent No.: US 7,732,391 B1
(45) **Date of Patent: *Jun. 8, 2010**

(54) MANUAL TRANSMISSION FLUID MADE WITH LUBRICATING BASE OIL HAVING HIGH MONOCYCLOPARAFFINS AND LOW MULTICYCLOPARAFFINS

(75) Inventors: John Rosenbaum, Richmond, CA (US); Marc J. De Weerdt, Machelen (BE); Thomas Plaetinck, Zomergem (BE); Nancy J. Bertrand, Lafayette, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1005 days.

This patent is subject to a terminal disclaimer.

(21) Appl. No.: 11/296,636

(22) Filed: Dec. 7, 2005

Related U.S. Application Data

(63) Continuation-in-part of application No. 10/743,932, filed on Dec. 23, 2003, now Pat. No. 7,195,706.

(51) Int. Cl.
*C10L 1/16* (2006.01)
*C10M 169/04* (2006.01)
*C10G 71/00* (2006.01)

(52) U.S. Cl. ..... 508/591; 508/110; 208/18; 208/19; 208/27; 208/950

(58) Field of Classification Search ..... 508/591, 508/110; 208/18, 950, 27, 19
See application file for complete search history.

(56) References Cited

U.S. PATENT DOCUMENTS

| | | | | |
|---|---|---|---|---|
| 5,135,638 | A | 8/1992 | Miller | |
| 5,282,958 | A | 2/1994 | Santilli et al. | |
| 7,476,645 | B2 * | 1/2009 | Rosenbaum et al. | 508/110 |
| 2005/0133407 | A1 | 6/2005 | Abernathy et al. | |
| 2005/0133408 | A1 * | 6/2005 | Abernathy et al. | 208/19 |
| 2005/0258078 | A1 * | 11/2005 | Rosenbaum et al. | 208/950 |
| 2005/0261145 | A1 * | 11/2005 | Rosenbaum et al. | 508/466 |
| 2005/0261146 | A1 * | 11/2005 | Rosenbaum et al. | 508/466 |
| 2005/0261147 | A1 * | 11/2005 | Rosenbaum et al. | 508/466 |

FOREIGN PATENT DOCUMENTS

| | | |
|---|---|---|
| WO | WO2005/017077 | 2/2005 |

* cited by examiner

*Primary Examiner*—Glenn A Caldarola
*Assistant Examiner*—Vishal Vasisth
(74) *Attorney, Agent, or Firm*—Susan M. Abernathy

(57) ABSTRACT

A manual transmission fluid having a VI greater than 160 and a Brookfield viscosity at −40° C. less than 30,000 cP. It comprises: 1) a base oil (made from a waxy feed) having less than 0.06 wt % aromatics, greater than 5 wt % total molecules with cycloparaffinic functionality, and a ratio of molecules with monocycloparaffinic functionality to molecules with multicycloparaffinic functionality greater than 20; and a manual transmission fluid additive package. In another embodiment, the manual transmission fluid comprises: 1) a base oil having a high VI and a kinematic viscosity at 100° C. greater than 5.5 cSt, 2) less than 0.01 wt % pour point depressant, and 3) a manual transmission fluid additive package. This invention is also directed to a process to make the manual transmission fluid, comprising the steps of hydroisomerization dewaxing, selecting base oil fractions having a high VI, and blending the fractions with an additive package.

28 Claims, No Drawings

MANUAL TRANSMISSION FLUID MADE WITH LUBRICATING BASE OIL HAVING HIGH MONOCYCLOPARAFFINS AND LOW MULTICYCLOPARAFFINS

This application is a continuation in part of U.S. patent application Ser. No. 10/743,932, filed Dec. 23, 2003, now U.S. Pat. No. 7,195,706.

FIELD OF THE INVENTION

This invention is directed to a manual transmission fluid with high viscosity index and excellent Brookfield viscosity at −40° C., and a process to make it.

BACKGROUND

Earlier base oils have been made from waxy feeds having desired cycloparaffin compositions, including high total weight percent molecules with cycloparaffin functionality and where the cycloparaffins are predominantly monocycloparaffinic. Examples of these oils are Shell XHVI 4.0 and solvent dewaxed waxy raffinate derived from FT wax.

PCT Patent Publication WO 2005/017077A2 discloses that functional fluids with low Brookfield viscosity may be made using base oils having a low ratio of measured to theoretical low temperature viscosity. Nothing is taught about the base oils having a desired predominantly monocycloparaffinic molecular composition, and it is likely that they do not have this characteristic.

It is desired to make manual transmission fluids that have a very high viscosity index and low Brookfield viscosity out of base oils, made from a waxy feed, that have high viscosity index and preferred cycloparaffin composition.

SUMMARY

This invention is directed to a manual transmission fluid comprising: 1) a base oil, made from a waxy feed, having less than 0.06 weight percent aromatics, greater than 5 weight percent total molecules with cycloparaffinic functionality, and a ratio of molecules with monocycloparaffinic functionality to molecules with multicycloparaffinic functionality greater than 20; and 2) a manual transmission fluid additive package; wherein the manual transmission fluid has a viscosity index greater than 160 and a Brookfield viscosity at −40° C. less than 30,000 cP.

This invention is also directed to a manual transmission fluid, comprising: a) a base oil having a viscosity index greater than an amount defined by the equation: VI=28×Ln (Kinematic Viscosity at 100 degrees C.)+100, and a kinematic viscosity at 100 degrees C. greater than 5.5 cSt; b) less than 0.01 weight percent pour point depressant; and a manual transmission fluid additive package; wherein the manual transmission fluid has a viscosity index greater than 160 and a Brookfield viscosity at −40 degrees C. less than 30,000 cP.

This invention is also directed to a process for making a manual transmission fluid, comprising: a) producing a base oil by hydroisomerization dewaxing a waxy feed having greater than 50 weight percent n-paraffins, a weight ratio of molecules of at least 60 carbons to molecules of at least 30 carbons less than 0.18, and a T90 boiling point between 660° F. (349° C.) and 1200° F. (649° C.); b) selecting one or more fractions of the base oil having a viscosity index greater than an amount defined by the equation: VI=28×Ln(Kinematic Viscosity at 100° C.)+100; and c) blending the one or more fractions with a manual transmission fluid additive package to produce a manual transmission fluid having a VI greater than 160 and a Brookfield viscosity at −40° C. less than 30,000 cP.

DETAILED DESCRIPTION

Manual transmission fluid is used in automotive transmissions that allow the driver to choose the gear ratio at any time according to the driving conditions and the desired driving style. In a manual transmission, the clutch has been designed to connect and disconnect the engine with the transmission. When changing gears, the clutch is disengaged which enables the driver to use the selector fork to engage the appropriate gear and then engage the clutch. As the car changes speeds, the driver selects the appropriate gear ratio. Development work is underway to automate manual transmissions. Automated manual transmissions automate the gear shifting, but the majority of the hardware and lubrication requirements are the same as for manual transmissions. The manual transmission fluid is formulated with lubricating base oil and additives that protect the gears, synchronizers, bearings and clutch material under operation of the manual transmission or automated manual transmission. The highest quality manual transmission fluids have high viscosity index, low Brookfield viscosity, and good oxidation stability.

This invention provides a manual transmission fluid with a VI greater than 160, preferably greater than 175; and a Brookfield viscosity at −40° C. less than 30,000, preferably less than 26,000; made using a lubricating base oil with desired cycloparaffin composition that is made from a waxy feed.

Lubricating Base Oil Made from a Waxy Feed:

The lubricating base oils used in the manual transmission fluid of this invention are made from a waxy feed. The waxy feed useful in the practice of this invention will generally comprise at least 40 weight percent n-paraffins, preferably greater than 50 weight percent n-paraffins, and more preferably greater than 75 weight percent n-paraffins. The weight percent n-paraffins is typically determined by gas chromatography, such as described in detail in U.S. patent application Ser. No. 10/897,906, filed Jul. 22, 2004, incorporated by reference. The waxy feed may be a conventional petroleum derived feed, such as, for example, slack wax, or it may be derived from a synthetic feed, such as, for example, a feed prepared from a Fischer-Tropsch synthesis. A major portion of the feed should boil above 650 degrees F. Preferably, at least 80 weight percent of the feed will boil above 650 degrees F., and most preferably at least 90 weight percent will boil above 650 degrees F. Highly paraffinic feeds used in carrying out the invention typically will have an initial pour point above 0 degrees C., more usually above 10 degrees C.

The wax feed preferably has a weight ratio of molecules of at least 60 carbons to molecules of at least 30 carbons less than 0.18. The weight ratio of molecules of at least 60 carbons to molecules of at least 30 carbons is determined by: 1) measuring the boiling point distribution of the Fischer-Tropsch wax by simulated distillation using ASTM D 6352; 2) converting the boiling points to percent weight distribution by carbon number, using the boiling points of n-paraffins published in Table 1 of ASTM D 6352-98; 3) summing the weight percents of products of carbon number 30 or greater; 4) summing the weight percents of products of carbon number 60 or greater; 5) dividing the sum of weight percents of products of carbon number 60 or greater by the sum of weight percents of products of carbon number 30 or greater. Other preferred embodiments of this invention use Fischer-Tropsch wax having a weight ratio of molecules having at least 60 carbons to molecules having at least 30 carbons less than 0.15, or less than 0.10. The wax feed also preferably has a T90 boiling point between 660° F. (349° C.) and 1200° F. (649° C.). The T90 boiling point is determined by simulated distillation using ASTM D 6352.

The term "Fischer-Tropsch derived" means that the product, fraction, or feed originates from or is produced at some stage by a Fischer-Tropsch process. The feedstock for the Fischer-Tropsch process may come from a wide variety of hydrocarbonaceous resources, including natural gas, coal, shale oil, petroleum, municipal waste, derivatives of these, and combinations thereof.

Slack wax can be obtained from conventional petroleum derived feedstocks by either hydrocracking or by solvent refining of the lube oil fraction. Typically, slack wax is recovered from solvent dewaxing feedstocks prepared by one of these processes. Hydrocracking is usually preferred because hydrocracking will also reduce the nitrogen content to a low value. With slack wax derived from solvent refined oils, deoiling may be used to reduce the nitrogen content. Hydrotreating of the slack wax can be used to lower the nitrogen and sulfur content. Slack waxes posses a very high viscosity index, normally in the range of from about 140 to 200, depending on the oil content and the starting material from which the slack wax was prepared. Therefore, slack waxes are suitable for the preparation of lubricating base oils having a very high viscosity index.

The waxy feed useful in this invention preferably has less than 25 ppm total combined nitrogen and sulfur. Nitrogen is measured by melting the waxy feed prior to oxidative combustion and chemiluminescence detection by ASTM D 4629-96. The test method is further described in U.S. Pat. No. 6,503,956, incorporated herein. Sulfur is measured by melting the waxy feed prior to ultraviolet fluorescence by ASTM D 5453-00. The test method is further described in U.S. Pat. No. 6,503,956, incorporated herein.

Waxy feeds useful in this invention are expected to be plentiful and relatively cost competitive in the near future as large-scale Fischer-Tropsch synthesis processes come into production. Syncrude prepared from the Fischer-Tropsch process comprises a mixture of various solid, liquid, and gaseous hydrocarbons. Those Fischer-Tropsch products which boil within the range of lubricating base oil contain a high proportion of wax which makes them ideal candidates for processing into lubricating base oil. Accordingly, Fischer-Tropsch wax represents an excellent feed for preparing high quality lubricating base oils according to the process of the invention. Fischer-Tropsch wax is normally solid at room temperature and, consequently, displays poor low temperature properties, such as pour point and cloud point. However, following hydroisomerization of the wax, Fischer-Tropsch derived lubricating base oils having excellent low temperature properties may be prepared. A general description of suitable hydroisomerization dewaxing processes may be found in U.S. Pat. Nos. 5,135,638 and 5,282,958; and U.S. patent application Ser. No. 10/744,870 filed December 23, incorporated herein.

The hydroisomerization is achieved by contacting the waxy feed with a hydroisomerization catalyst in an isomerization zone under hydroisomerizing conditions. The hydroisomerization catalyst preferably comprises a shape selective intermediate pore size molecular sieve, a noble metal hydrogenation component, and a refractory oxide support. The shape selective intermediate pore size molecular sieve is preferably selected from the group consisting of SAPO-11, SAPO-31, SAPO-41, SM-3, ZSM-22, ZSM-23, ZSM-35, ZSM-48, ZSM-57, SSZ-32, offretite, ferrierite, and combinations thereof. SAPO-11, SM-3, SSZ-32, ZSM-23, and combinations thereof are more preferred. Preferably the noble metal hydrogenation component is platinum, palladium, or combinations thereof.

The hydroisomerizing conditions depend on the waxy feed used, the hydroisomerization catalyst used, whether or not the catalyst is sulfided, the desired yield, and the desired properties of the lubricating base oil. Preferred hydroisomerizing conditions useful in the current invention include temperatures of 260 degrees C. to about 413 degrees C. (500 to about 775 degrees F.), a total pressure of 15 to 3000 psig, and a hydrogen to feed ratio from about 0.5 to 30 MSCF/bbl, preferably from about 1 to about 10 MSCF/bbl, more preferably from about 4 to about 8 MSCF/bbl. Generally, hydrogen will be separated from the product and recycled to the isomerization zone.

The hydroisomerization conditions are preferably tailored to produce one or more fractions having greater than 5 weight percent total molecules with cycloparaffinic functionality, more preferably having greater than 10 weight percent total molecules with cycloparaffinic functionality, even more preferably having greater than 15 weight percent total molecules with cycloparaffinic functionality. The fractions will preferably have a ratio of molecules with monocycloparaffinic functionality to molecules with multicycloparaffinic functionality greater than 5, more preferably greater than 20, even more preferably greater than 30 or greater than 50. The fractions will typically have a viscosity index greater than an amount calculated by the equation: VI=28×Ln(Kinematic Viscosity at 100° C.)+95 and a pour point less than zero degrees C. Preferably the fractions will have a viscosity index greater than an amount calculated by the equation: VI=28×Ln(Kinematic Viscosity at 100° C.)+100, more preferably by the equation: VI=28×Ln(Kinematic Viscosity at 100° C.)+105. Preferably the pour point will be less than −10 degrees C., and preferably the ratio of pour point to kinematic viscosity at 100° C. will be greater than a Base Oil Pour Factor. The Base Oil Pour Factor is calculated by the equation BOPF=7.35×Ln(Kinematic Viscosity at 100° C.)−18. "Ln" in the VI and BOPF equations refers to the natural logarithm to the base 'e'. Viscosity index is determined by ASTM D 2270-93 (1998). Kinematic Viscosity at 100° C. is determined by ASTM D 445.

Optionally, the lubricating base oil produced by hydroisomerization dewaxing may be hydrofinished. The hydrofinishing may occur in one or more steps, either before or after fractionating of the lubricating base oil into one or more fractions. The hydrofinishing is intended to improve the oxidation stability, UV stability, and appearance of the product by removing aromatics, olefins, color bodies, and solvents. A general description of hydrofinishing may be found in U.S. Pat. Nos. 3,852,207 and 4,673,487, incorporated herein. The hydrofinishing step may be needed to reduce the weight percent olefins in the lubricating base oil to less than 10, preferably less than 5, more preferably less than 1, and most preferably less than 0.8. The hydrofinishing step may also be needed to reduce the weight percent aromatics to less than 0.3, preferably less than 0.06, more preferably less than 0.05, and most preferably less than 0.02.

In a preferred embodiment the hydroisomerizing and hydrofinishing conditions in the process of this invention are tailored to produce one or more selected fractions of lubricating base oil having greater than 10 weight percent total molecules with cycloparaffinic functionality, and a ratio of molecules with monocycloparaffinic functionality to molecules with multicycloparaffinic functionality greater than 20. The one or more selected fractions of lubricating base oil have a kinematic viscosity at 100° C. between about 2 cSt and about 20 cSt. The fractions may be separated into different viscosity grades by vacuum distillation.

The lubricating base oil fractions have greater than 50 weight percent non-cyclic isoparaffins. They have measurable quantities of unsaturated molecules measured by FIMS. Generally they have greater than 5 weight percent total molecules with cycloparaffinic functionality. Preferably they have greater than 10 weight percent total molecules with cycloparaffinic functionality, more preferably greater than 15. They preferably have a ratio of weight percent total molecules with cycloparaffinic functionality to weight percent molecules with multicycloparaffinic functionality greater than 5, more preferably greater than 20, even more preferably greater than 30 or 50. The presence of predominantly cycloparaffinic molecules with monocycloparaffinic functionality in the lubricating base oil fractions provides excellent oxidation stability, high viscosity index, low Noack volatility, as well as desired additive solubility and elastomer compatibility.

The lubricating base oil fractions additionally have very low traction coefficients, preferably less than or equal to 0.021 when measured at a kinematic viscosity of 15 cSt and at a slide to roll ratio of 40 percent. Examples of these preferred base oil fractions are taught in U.S. patent application Ser. No. 10/835,219, filed Apr. 29, 2004.

Molecular Composition by FIMS:

The lubricating base oils made from a waxy feed of this invention were characterized by Field Ionization Mass Spectroscopy (FIMS) into alkanes and molecules with different numbers of unsaturations. The distribution of the molecules in the oil fractions was determined by FIMS. The samples were introduced via solid probe, preferably by placing a small amount (about 0.1 mg.) of the lubricating base oil to be tested in a glass capillary tube. The capillary tube was placed at the tip of a solids probe for a mass spectrometer, and the probe was heated from about 50° C. up to 600° C. at a rate of 100° C. per minute in a mass spectrometer operating at about 10-6 torr. The mass spectrometer was scanned from m/z 40 to m/z 1000 at a rate of 5 seconds per decade.

The mass spectrometer used was a Micromass Time-of-Flight. Response factors for all compound types were assumed to be 1.0, such that weight percent was determined from area percent. The acquired mass spectra were summed to generate one "averaged" spectrum.

The lubricating base oils of this invention were characterized by FIMS into alkanes and molecules with different numbers of unsaturations. The molecules with different numbers of unsaturations may be comprised of cycloparaffins, olefins, and aromatics. If aromatics were present in significant amounts in the lubricating base oil they would predominantly be identified in the FIMS analysis as 4-unsaturations. When olefins were present in significant amounts in the lubricating base oil they would be predominantly identified in the FIMS analysis as 1-unsaturations. The total of the 1-unsaturations, 2-unsaturations, 3-unsaturations, 4-unsaturations, 5-unsaturations, and 6-unsaturations from the FIMS analysis, minus the wt % olefins by $^1$H NMR, and minus the wt % aromatics by HPLC-UV is the total weight percent of molecules with cycloparaffinic functionality in the lubricating base oils of this invention. Note that if the aromatics content was not measured, it was assumed to be less than 0.1 wt % and not included in the calculation for total weight percent of molecules with cycloparaffinic functionality.

Molecules with cycloparaffinic functionality mean any molecule that is, or contains as one or more substituents, a monocyclic or a fused multicyclic saturated hydrocarbon group. The cycloparaffinic group may be optionally substituted with one or more substituents. Representative examples include, but are not limited to, cyclopropyl, cyclobutyl, cyclopentyl, cyclohexyl, cycloheptyl, decahydronaphthalene, octahydropentalene, (pentadecan-6-yl)cyclohexane, 3,7,10-tricyclohexylpentadecane, decahydro-1-(pentadecan-6-yl) naphthalene, and the like.

Molecules with monocycloparaffinic functionality mean any molecule that is a monocyclic saturated hydrocarbon group of three to seven ring carbons or any molecule that is substituted with a single monocyclic saturated hydrocarbon group of three to seven ring carbons. The cycloparaffinic group may be optionally substituted with one or more substituents. Representative examples include, but are not limited to, cyclopropyl, cyclobutyl, cyclopentyl, cyclohexyl, cycloheptyl, (pentadecan-6-yl) cyclohexane, and the like.

Molecules with multicycloparaffinic functionality mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon group of three to seven ring carbons. The fused multicyclic saturated hydrocarbon ring group preferably is of two fused rings. The cycloparaffinic group may be optionally substituted with one or more substituents. Representative examples include, but are not limited to, decahydronaphthalene, octahydropentalene, 3,7,10-tricyclohexylpentadecane, decahydro-1-(pentadecan-6-yl) naphthalene, and the like.

Wt % Olefins:

The Wt % Olefins in the lubricating base oils of this invention were determined by proton-N MR by the following steps, A-D:

A. Prepare a solution of 5-10% of the test hydrocarbon in deuterochloroform.

B. Acquire a normal proton spectrum of at least 12 ppm spectral width and accurately reference the chemical shift (ppm) axis. The instrument must have sufficient gain range to acquire a signal without overloading the receiver/ADC. When a 30 degree pulse is applied, the instrument must have a minimum signal digitization dynamic range of 65,000. Preferably the dynamic range will be 260,000 or more.

C. Measure the integral intensities between:

6.0-4.5 ppm (olefin)
2.2-1.9 ppm (allylic)
1.9-0.5 ppm (saturate)

D. Using the molecular weight of the test substance determined by ASTM D 2503, calculate:

1. The average molecular formula of the saturated hydrocarbons
2. The average molecular formula of the olefins
3. The total integral intensity (=sum of all integral intensities)
4. The integral intensity per sample hydrogen (=total integral/number of hydrogens in formula)
5. The number of olefin hydrogens (=Olefin integral/integral per hydrogen)
6. The number of double bonds (=Olefin hydrogen times hydrogens in olefin formula/2)
7. The wt % olefins by $^1$H NMR=100 times the number of double bonds times the number of hydrogens in a typical olefin molecule divided by the number of hydrogens in a typical test substance molecule.

The wt % olefins by $^1$H NMR calculation procedure, D, works best when the % olefins result is low, less than about 15 weight percent. The olefins must be "conventional" olefins; i.e. a distributed mixture of those olefin types having hydrogens attached to the double bond carbons such as: alpha, vinylidene, cis, trans, and trisubstituted. These olefin types will have a detectable allylic to olefin integral ratio between 1 and about 2.5. When this ratio exceeds about 3, it indicates a higher percentage of tri or tetra substituted olefins are present and that different assumptions must be made to calculate the number of double bonds in the sample.

Aromatics Measurement by HPLC-UV:

The method used to measure low levels of molecules with at least one aromatic function in the lubricating base oils of this invention employed a Hewlett Packard 1050 Series Quaternary Gradient High Performance Liquid Chromatography (HPLC) system coupled with a HP 1050 Diode-Array UV-V is detector interfaced to an HP Chem-station. Identification of the individual aromatic classes in the highly saturated lubricating base oils was made on the basis of their UV spectral pattern and their elution time. The amino column used for this analysis differentiates aromatic molecules largely on the basis of their ring-number (or more correctly, double-bond number). Thus, the single ring aromatic containing molecules elute first, followed by the polycyclic aromatics in order of increasing double bond number per molecule. For aromatics with similar double bond character, those with only alkyl substitution on the ring elute sooner than those with naphthenic substitution.

Unequivocal identification of the various base oil aromatic hydrocarbons from their UV absorbance spectra was accomplished recognizing that their peak electronic transitions were all red-shifted relative to the pure model compound analogs to a degree dependent on the amount of alkyl and naphthenic substitution on the ring system. These bathochromic shifts are well known to be caused by alkyl-group delocalization of the -electrons in the aromatic ring. Since few unsubstituted aromatic compounds boil in the lubricant range, some degree of red-shift was expected and observed for all of the principle aromatic groups identified.

Quantitation of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricating base oils.

HPLC-UV Calibration:

HPLC-UV was used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-1-ring aromatic naphthenes and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in lubricating base oils exhibit a distinct peak absorbance at 272 nm that corresponds to the same (forbidden) transition that unsubstituted tetralin model compounds do at 268 nm. The concentration of alkyl-1-ring aromatic naphthenes in lubricating base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole lubricating base oil sample.

This calibration method was further improved by isolating the 1-ring aromatics directly from the lubricating base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricating base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR:

The weight percent of all molecules with at least one aromatic function in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated lubricating base oils were single-ring aromatics.

High power, long duration, and good baseline analysis were needed to accurately measure aromatics down to 0.2% aromatic molecules. More specifically, to accurately measure low levels of all molecules with at least one aromatic function by NMR, the standard D 5292-99 method was modified to give a minimum carbon sensitivity of 500:1 (by ASTM standard practice E 386). A15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

The lubricating base oil fractions have a weight percent olefins less than 10, preferably less than 5, more preferably less than 1, and most preferably less than 0.8. The lubricating base oil fractions preferably have a weight percent aromatics less than 0.3, more preferably less than 0.06, and most preferably less than 0.02. In one embodiment, where the aromatics and olefin contents of the base oil are low, the lubricating base oil fractions have an Oxidator BN greater than 25 hours, preferably greater than 30 hours, even more preferably greater than 40 hours.

A convenient way to measure the stability of lubricating base oils is by the use of the Oxidator BN Test, as described by Stangeland et al. in U.S. Pat. No. 3,852,207. The Oxidator BN test measures the resistance to oxidation by means of a Dornte-type oxygen absorption apparatus. See R. W. Dornte "Oxidation of White Oils," Industrial and Engineering Chemistry, Vol. 28, page 26, 1936. Normally, the conditions are one atmosphere of pure oxygen at 340° F. The results are reported in hours to absorb 1000 ml of $O_2$ by 100 g. of oil. In the Oxidator BN test, 0.8 ml of catalyst is used per 100 grams of oil and an additive package is included in the oil. The catalyst is a mixture of soluble metal naphthenates in kerosene. The mixture of soluble metal naphthenates simulates the average metal analysis of used crankcase oil. The level of metals in the catalyst is as follows: Copper=6,927 ppm; Iron=4,083 ppm; Lead=80,208 ppm; Manganese=350 ppm; Tin=3565 ppm. The additive package is 80 millimoles of zinc bispolypropylenephenyldithio-phosphate per 100 grams of oil, or approximately 1.1 grams of OLOA 260. The Oxidator BN test measures the response of a lubricating base oil in a simulated application. High values, or long times to absorb one liter of oxygen, indicate good oxidation stability. Traditionally it is considered that the Oxidator BN of a base oil suitable for use in a manual transmission fluid should be above 7 hours.

OLOA is an acronym for Oronite Lubricating Oil Additive®, which is a registered trademark of Chevron Oronite.

The lubricating base oils useful in this invention are distinct from polyalphaolefins in that they are made from a waxy feed. Another distinction between polyalphaolefins and the lubricating base oils useful in this invention are that polyalphaolefins do not contain hydrocarbon molecules having consecutive numbers of carbon atoms. Polyalphaolefins are tri-, tetra- or penta-oligomers of 1-alkenes. Polyalphaolefins are small aliphatic molecules with branching of long alkyl chains at 2-, 4-, 6-, etc. positions, the positions depending upon the extent of oligomerization. Unlike polyalphaolefins, the lubricating base oils useful in our invention contain hydrocarbon molecules having consecutive numbers of carbon atoms.

Manual Transmission Fluid Additive Package:

Manual transmission fluid additive packages generally contain one or more anti-wear agents, ashless dispersants, detergents, corrosion inhibitors, EP agents, friction modifiers, anti-foamants, seal swell agents, and sometimes viscosity index improvers and pour point depressants. They are generally formulated to meet the ASTM D 5760 Standard Specification for Performance of Manual Transmission Gear Lubricants. Usually they are formulated to meet specific original equipment manufacturer (OEM) requirements. An example of a commercially available manual transmission fluid additive package is described in U.S. Pat. No. 6,713,439. Infineum, Lubrizol and Oronite sell manual transmission fluid additive packages. Lubrizol markets theirs under the ANGLAMOL® trademark. Many manual transmission fluid additive packages contain sulfur-phosphorus extreme pressure antiwear agents. Others may contain inorganic borate extreme pressure antiwear agents. An example of a preferred manual transmission fluid additive package comprises an oil dispersion of hexagonal boron nitride and viscosity index improver selected from polymethacrylate, dispersant polymethacrylate and dispersant olefin copolymer. This additive composition has good anti-sticking properties when used in transmission oils. It is described in detail in U.S. Patent Application 20050119134. Manual transmission fluid additives generally comprise from about 1% to about 20% of the weight of the finished lubricant, preferably from about 1% to about 15% of the weight of the finished lubricant.

Viscosity Index Improvers (VI Improvers):

Generally VI improvers are olefin homo- or co-polymers or derivative thereof of number average molecular weight of about 15000 to 1 million atomic mass units (amu), generally added to manual transmission fluids at concentrations from about 4 to 15 wt %. They function by thickening the lubricating oil to which they are added more at high temperatures than low, thus keeping the viscosity change of the lubricant with temperature more constant than would otherwise be the case. The change in viscosity with temperature is commonly represented by the viscosity index (VI), with the viscosity of oils with large VI (e.g. 140) changing less with temperature than the viscosity of oils with low VI (e.g. 90).

Major classes of VI improvers include: polymers and copolymers of methacrylate and acrylate esters; ethylene-propylene copolymers; styrene-diene copolymers; and polyisobutylene, VI improvers are often hydrogenated to remove residual olefin. VI improver derivatives include dispersant VI improver, which contain polar functionalities such as grafted succinimide groups. The manual transmission fluid of this invention typically has less than 11 wt %, preferably less than 7 wt % VI improver.

Pour Point Depressant:

Pour point depressant may be included in the manual transmission fluids of this invention. Examples of suitable pour point depressants include polymethacrylates, polyacrylates, polyarylamides, condensation products of haloparaffin waxes, aromatic compounds, vinyl carboxylate polymers, terpolymers of dialkylfumarates, vinyl esters of fatty acids, allyl vinyl ethers, and distillate bottoms of hydroisomerized waxes. Examples of distillate bottoms of hydroisomerized waxes suitable for use as pour point depressants are taught in U.S. patent application Ser. Nos. 10/704,031 and 10/839,396, incorporated herein in their entirety. Typical levels of pour point depressant, when one is used, are between 0.01 to 5 weight percent.

In some embodiments of this invention the manual transmission fluid may contain less than 0.01 weight percent, or even zero, pour point depressant and still have a very low Brookfield viscosity.

Modern Manual Transmissions:

Modern manual transmissions require a fluid with exceptional stability as it is preferred that they remain in the transmission for the life of the transmission (100,000+ miles). They also require superior shear stability due to the extended service life. Manual transmission fluids made from the base oils described in this disclosure with very high viscosity indexes will require less VI improver and will have better shear stability. Additionally, they will have a thicker oil film and provide better gear wear protection. The manual transmission fluid will do an excellent job of protecting against gear pitting damage. The preferred base oils of this invention with low olefins and aromatics will also have better oxidation stability than most other base oils.

EXAMPLES

Example 1

Three distillate fractions (FT-3, FT-4.5 and FT-6.4) and a distillate bottoms fraction (FT-14) of base oil made from the hydroisomerization of a Fischer-Tropsch derived waxy feed were produced in a pilot plant. The properties of these base oils are summarized in Table I.

TABLE I

| Properties | PGQ0118 FT-3 | WOW9462 FT-4.5 | PGQ2417 FT-6.4 | PGQ2249 FT-14 |
|---|---|---|---|---|
| Viscosity at 100° C., cSt | 2.981 | 4.514 | 6.362 | 13.99 |
| Viscosity Index | 127 | 148 | 153 | 157 |
| Wt % Aromatics | 0.013 | 0.053 | 0.059 | 0.041 |
| Wt % Olefins | 0.9 | 4.05 | 3.49 | 3.17 |
| FIMS, Wt % | | | | |
| Alkanes | 89.2 | 77.6 | 68.1 | 58.5 |
| 1—Unsaturations | 10.8 | 22.4 | 31.2 | 40.2 |
| 2—Unsaturations | 0.0 | 0.0 | 0.7 | 0.8 |
| 3—Unsaturations | 0.0 | 0.0 | 0.0 | 0.0 |
| 4—Unsaturations | 0.0 | 0.0 | 0.0 | 0.0 |
| 5—Unsaturations | 0.0 | 0.0 | 0.0 | 0.0 |
| 6—Unsaturations | 0.0 | 0.0 | 0.0 | 0.0 |
| Total | 100.0 | 100.0 | 100.0 | 100.0 |
| Total Molecules with Cycloparaffinic Functionality | 9.9 | 18.2 | 28.31 | 37.83 |
| Monocycloparaffins/ Multicycloparaffins | >100 | >100 | 39.6 | 46.3 |
| Boiling Point Distribution, ° F. | | | | |
| T5 | 670 | 742 | 847 | 963 |
| T10 | 681 | 755 | 856 | 972 |
| T20 | 697 | 773 | 869 | 990 |
| T30 | 713 | 791 | 881 | 1006 |
| T50 | 744 | 831 | 905 | 1045 |
| T70 | 776 | 878 | 931 | 1090 |
| T80 | 792 | 906 | 946 | 1122 |
| T90 | 808 | 938 | 962 | 1168 |
| T95 | 817 | 957 | 972 | 1203 |
| Pour Point, ° C. | −27 | −17 | −23 | −8 |
| X in the equation VI = 28 × Ln(VIS100) + X | 96.4 | 105.8 | 101.2 | 83 |

FT-3, FT-4.5, FT-6.4, and FT-14 are all examples of the base oils useful in the manual transmission fluids of this invention. They have less than 0.06 wt % aromatics, greater than 5 wt % total molecules with cycloparaffinic functionality, and a ratio of molecules with monocycloparaffinic functionality to molecules with multicycloparaffinic functionality greater than 20. FT-4.5 and FT-6.4 are preferred as they have a VI greater than an amount determined by the equation VI=28×Ln(VIS100)+100. FT-4.5 is especially preferred as it has a VI greater than an amount determined by the equation VI=28×Ln(VIS100)+105.

Example 2

Four different blends of factory fill passenger car manual transmission fluid were blended with the base oils described in example 1.

TABLE II

| Component, Wt % | MTFA | MTFB | MTFC | MTFD |
|---|---|---|---|---|
| FT-3 | 12.0 | 12.0 | 0 | 0 |
| FT-4.5 | 65.5 | 65.8 | 41.0 | 24.0 |
| FT-6.4 | 0 | 0 | 41.0 | 60.0 |
| MTF Additive Pkg. | 11.5 | 11.5 | 11.5 | 11.5 |
| Viscoplex PPD | 0.3 | 0 | 0.5 | 0.5 |
| Viscoplex VI Improver | 10.7 | 10.7 | 6.0 | 4.0 |
| Total | 100.0 | 100.0 | 100.0 | 100.0 |

The viscometric properties of each of the four blends are shown in Table III.

TABLE III

| Properties | SPEC | MTFA | MTFB | MTFC | MTFD |
|---|---|---|---|---|---|
| Viscosity at 100° C., cSt | 8.5-9.2 | 8.7 | 8.54 | 8.87 | 8.57 |
| Viscosity at 40° C., cSt | | 42.24 | 41.83 | 46.07 | 41.67 |
| VI | | 191 | 188 | 176 | 190 |
| Brookfield Viscosity at −40° C., cP | 30000 Max | 12400 | 19800 | 19900 | 25300 |

All four of these blends are examples of the manual transmission fluid of this invention. They all comprise a base oil, made from a waxy feed, having less than 0.06 weight percent aromatics, greater than 5 weight percent total molecules having cycloparaffinic functionality, and a ratio of molecules with monocycloparaffinic functionality to molecules with multicycloparaffinic functionality greater than 20. All four of these blends have a VI greater than 160, and a Brookfield viscosity at −40° C. of less than 30,000 cP. MTFA has an especially preferred high VI and low Brookfield viscosity. It is surprising that MTFB, even without the inclusion of a pour point depressant, had excellent low Brookfield viscosity.

MTFC and MTFD are examples of a manual transmission fluid, comprising a base oil having a viscosity index greater than an amount defined by the equation: VI=28×Ln(Kinematic Viscosity at 100 degrees C.)+100, and a kinematic viscosity at 100 degrees C. greater than 5.5 cSt. MTFC and MTFD demonstrate that manual transmission fluids with very high VIs and low Brookfield viscosities may be blended with less than 7 weight percent of VI improver, when using the base oils defined in this disclosure. Manual transmission fluids with lower amounts of VI improver will have improved shear stability, and thicker oil films, which will provide exceptional protection against gear wear. It is especially surprising that MTFD, with the lowest amount of VI improver had such a high VI.

Example 3

Three different blends of factory fill heavy duty manual transmission fluid designed to meet top tier OEM heavy duty manual transmission fluid specifications were blended with different combinations of FT-6.4, PAO-6, PAO-8, and VISOM 6. Typical properties of PAO-6, PAO-8, and VISOM 6 are summarized in Table IV. The formulations of the three different blends are summarized in Table V. The properties of the blends are summarized in Table VI.

TABLE IV

| | PAO-6 | PAO-8 | VISOM 6 |
|---|---|---|---|
| Viscosity at 100° C., cSt | 5.898 | 7.795 | 6.620 |
| Viscosity Index | 137 | 136 | 146 |
| Pour Point, ° C. | −68 | −45 | −18 |
| Aromatics, Wt % | | | 0.5279 |
| Monocycloparaffins/Multicycloparaffins | | | 1.33 |
| X in the equation VI = 28 × Ln(VIS100) + X | 87.3 | 78.5 | 93.1 |

PAO-6 and PAO-8 are not base oils made from a waxy feed. VISOM 6, although made from a waxy feed, did not have the low aromatics and desired cycloparaffin composition of the base oils used in our invention.

TABLE V

| Component Wt % | Comparative MTFE | Comparative MTFF | MTFG |
|---|---|---|---|
| FT-6.4 | 0 | 0 | 54.5 |
| PAO-6 | 31.8 | 0 | 0 |
| PAO-8 | 51.2 | 27.0 | 28.0 |
| VISOM 6 | 0 | 55.8 | 0 |
| Top Tier Heavy Duty MTF Additive Package | 7.0 | 7.0 | 7.0 |
| VI Improver | 10.0 | 10.0 | 10.0 |
| Viscoplex PPD | 0 | 0.2 | 0.5 |
| Total | 100.0 | 100.0 | 100.0 |

TABLE VI

| Component Wt % | Comparative MTFE | Comparative MTFF | MTFG |
|---|---|---|---|
| Kinematic Viscosity at 100° C., cSt | 9.14 | 9.24 | 9.07 |
| Kinematic Viscosity at 40° C., cSt | 54.2 | 53.4 | 50.9 |
| Viscosity Index | 151 | 156 | 161 |
| Brookfield Viscosity at −40° C., cP | 19500 | 26600 | 24600 |

MTFG, which contained a base oil having a kinematic viscosity greater than 5.5 cSt at 100 degrees C. and a VI greater than an amount defined by the equation VI=28×Ln (VIS100)+100, was a manual transmission fluid meeting the specifications for OEM top tier heavy duty manual transmission fluid. MTFG had a VI greater than 160, in addition to having a very low Brookfield viscosity at −40 degrees C. Note that MTFG additionally comprises a polyalphaolefin base oil.

Example 4

Two distillate fractions (FT-4, FT-9.7) and a distillate bottoms fraction (FT-16) of base oil made from the hydroisomerization of a Fischer-Tropsch derived waxy feed were produced in a pilot plant. The base oils were hydrofinished at a higher pressure than those used in example 1, which significantly reduced the levels of olefins and aromatics in the base oils. The properties of these base oils are summarized in Table VII.

TABLE VII

| Properties | PGQ2654 FT-4 | PGQ2655 FT-9.7 | PGQ2653 FT-16 |
|---|---|---|---|
| Viscosity at 100° C., cSt | 3.994 | 9.716 | 16.48 |
| Viscosity Index | 143 | 161 | 149 |
| Wt % Olefins | 0.10 | 0.70 | 0.12 |
| FIMS, Wt % | | | |
| Alkanes | 82.4 | 66.7 | 61.5 |
| 1—Unsaturations | 17.6 | 32.5 | 38.1 |
| 2—Unsaturations | 0.0 | 0.0 | 0.4 |
| 3—Unsaturations | 0.0 | 0.0 | 0.0 |
| 4—Unsaturations | 0.0 | 0.0 | 0.0 |
| 5—Unsaturations | 0.0 | 0.0 | 0.0 |
| 6—Unsaturations | 0.0 | 0.0 | 0.0 |
| Total | 100.0 | 100.0 | 100.0 |
| Total Molecules with Cycloparaffinic Functionality | 17.5 | 31.8 | 38.4 |
| Monocycloparaffins/ Multicycloparaffins | >100 | >100 | 95 |
| Pour Point, ° C. | −16 | | −26 |
| X in the equation VI = 28 × Ln(VIS100) + X | 104.2 | 97.3 | 70.5 |
| Oxidator BN, hours | 43.97 | 37.53 | 42.90 |

These base oils had the more preferred properties of having less than 0.05 weight percent aromatics, greater than 15 weight percent total molecules with cycloparaffinic functionality, a ratio of molecules with monocycloparaffinic functionality to molecules with multicycloparaffinic functionality greater than 50, and less than 0.8 weight percent olefins. What is truly exceptional about these base oils are their very high oxidation stabilities. These base oils would make exceptional manual transmission fluids with very high VIs, excellent Brookfield viscosities, and long service lives. They would be especially beneficial when used in manual transmission fluids where extended service life is highly desired.

All of the publications, patents and patent applications cited in this application are herein incorporated by reference in their entirety to the same extent as if the disclosure of each individual publication, patent application or patent was specifically and individually indicated to be incorporated by reference in its entirety.

Many modifications of the exemplary embodiments of the invention disclosed above will readily occur to those skilled in the art. Accordingly, the invention is to be construed as including all structure and methods that fall within the scope of the appended claims.

We claim:

1. A manual transmission fluid, comprising:

a. a base oil, made from a waxy feed, having:

i. less than 0.06 weight percent aromatics;

ii. greater than 5 weight percent total molecules with cycloparaffinic functionality;

iii. a ratio of molecules with monocycloparaffinic functionality to molecules with multicycloparaffinic functionality greater than 20; and b. a manual transmission fluid additive package; wherein the manual transmission fluid has a VI greater than 160 and a Brookfield viscosity at −40° C. less than 30,000 cP.

2. The manual transmission fluid of claim 1, wherein the base oil has less than 0.05 weight percent aromatics.

3. The manual transmission fluid of claim 1, wherein the base oil additionally has less than 0.8 weight percent olefins.

4. The manual transmission fluid of claim 1, wherein the base oil has greater than 10 weight percent total molecules with cycloparaffinic functionality.

5. The manual transmission fluid of claim 4, wherein the base oil has greater than 15 weight percent total molecules with cycloparaffinic functionality.

6. The manual transmission fluid of claim 1, wherein the base oil has a ratio of molecules with monocycloparaffinic functionality to molecules with multicycloparaffinic functionality greater than 30.

7. The manual transmission fluid of claim 6, wherein the base oil has a ratio of molecules with monocycloparaffinic functionality to molecules with multicycloparaffinic functionality greater than 50.

8. The manual transmission fluid of claim 1, wherein the base oil additionally has a viscosity index greater than an amount calculated by the equation: VI=28×Ln (Kinematic Viscosity at 100 degrees C.)+100.

9. The manual transmission fluid of claim 8, wherein the base oil additionally has a viscosity index greater than an amount calculated by the equation: VI=28×Ln (Kinematic Viscosity at 100 degrees C.)+105.

10. The manual transmission fluid of claim 1, wherein the base oil additionally has a kinematic viscosity at 100 degrees C. greater than 5.5 cSt.

11. The manual transmission fluid of claim 1, wherein the manual transmission fluid has a VI greater than 175 and a Brookfield viscosity at −40° C. less than 26,000 cP.

12. The manual transmission fluid of claim 1, additionally comprising less than 7 weight percent viscosity index improver.

13. The manual transmission fluid of claim 1, wherein the waxy feed is Fischer-Tropsch derived.

14. The manual transmission fluid of claim 1, wherein the base oil additionally has a coefficient of traction less than or equal to 0.022, when measured at a kinematic viscosity of 15 cSt and at a slide to roll ratio of 40 percent.

15. The manual transmission fluid of claim 1, wherein the base oil additionally has an Oxidator BN greater than 30 hours.

16. A manual transmission fluid, comprising:

a. a base oil, having:

i. a viscosity index greater than an amount defined by the equation: VI=28×Ln (Kinematic Viscosity at 100 degrees C.)+100;

ii. a kinematic viscosity at 100 degrees C. greater than 5.5 cSt;

b. less than 0.01 weight percent pour point depressant; and c. a manual transmission fluid additive package;

wherein the manual transmission fluid has a viscosity index greater than 160 and a Brookfield viscosity at −40 degrees C. less than 30,000 cP.

17. The manual transmission fluid of claim 16, wherein the base oil additionally has an Oxidator BN greater than 30 hours.

18. The manual transmission fluid of claim 16, wherein the base oil is made from a Fischer-Tropsch derived waxy feed.

19. The manual transmission fluid of claim 16, wherein the manual transmission fluid has a viscosity index greater than 175 and a Brookfield viscosity at −40 degrees C. less than 26,000 cP.

20. A process for making a manual transmission fluid, comprising:

a. producing a base oil by hydroisomerization dewaxing a waxy feed having:

i. greater than 50 weight percent n-paraffins, ii. a weight ratio of molecules of at least 60 carbons to molecules of at least 30 carbons less than 0.18, iii. and a T90 boiling point between 660° F. (349° C.) and 1200° F. (649° C.);

b. selecting one or more fractions of the base oil having a viscosity index greater than an amount defined by the equation: VI=28×Ln(Kinematic Viscosity at 100° C.)+100;

c. blending the one or more fractions with a manual transmission fluid additive package to produce a manual transmission fluid having a VI greater than 160 and a Brookfield viscosity at −40° C. less than 30,000 cP.

21. The process of claim 20, wherein the one or more base oil fractions have greater than 5 weight percent total molecules with cycloparaffinic functionality.

22. The process of claim 21, wherein the one or more base oil fractions have greater than 10 weight percent total molecules with cycloparaffinic functionality.

23. The process of claim 20, wherein the one or more base oil fractions have a ratio of molecules with monocycloparaffinic functionality to molecules with multicycloparaffinic functionality greater than 5.

24. The process of claim 23, wherein the ratio of molecules with monocycloparaffinic functionality to molecules with multicycloparaffinic function is greater than 20.

25. The process of claim 20, wherein the one or more base oil fractions have a ratio of pour point to kinematic viscosity greater than a Base Oil Pour Factor, where the Base Oil Pour Factor=7.35×Ln(Kinematic Viscosity at 100° C.)−18.

26. The process of claim 20, wherein the one or more base oil fractions have a traction coefficient less than or equal to 0.021 when measured at a kinematic viscosity of 15 cSt and at a slide to roll ratio of 40 percent.

27. The process of claim 20, additionally comprising blending the one or more fractions with a polyalphaolefin or polyinternal olefin.

28. The process of claim 20, additionally comprising blending the one or more fractions with less than 7 weight percent viscosity index improver.

* * * * *